US006217939B1

(12) United States Patent
Sailer et al.

(10) Patent No.: US 6,217,939 B1
(45) Date of Patent: Apr. 17, 2001

(54) WOOD TREATMENT PROCESS

(75) Inventors: Michael Sailer; Andreas Otto Rapp, both of Hamburg (DE)

(73) Assignee: Martin Menz, Ehrenberg-Reulbach (DE)

( * ) Notice: Subject to any disclaimer, the term of this patent is extended or adjusted under 35 U.S.C. 154(b) by 0 days.

(21) Appl. No.: 09/441,370

(22) Filed: Nov. 17, 1999

(30) Foreign Application Priority Data

Nov. 17, 1998 (DE) ..... 198 52 827

(51) Int. Cl.[7] ..... B05D 7/06

(52) U.S. Cl. ..... 427/325; 427/370; 427/382; 427/393; 427/441

(58) Field of Search ..... 427/317, 325, 427/441, 351, 379, 382, 393, 369, 370

(56) References Cited

U.S. PATENT DOCUMENTS

| | | | | |
|---|---|---|---|---|
| 3,995,077 | * | 11/1976 | Hager | 427/393 |
| 5,244,472 | | 9/1993 | Simmons | 44/505 |

FOREIGN PATENT DOCUMENTS

| | | | |
|---|---|---|---|
| 1 000 592 | | 1/1957 | (DE) . |
| 29 16 677 | | 11/1980 | (DE) . |
| 30 43 659 | | 7/1982 | (DE) . |
| 41 12 643 | | 10/1992 | (DE) . |
| 44 12 296 | | 10/1995 | (DE) . |
| 197 15 664 | | 10/1998 | (DE) . |
| 0 510 435 | | 10/1992 | (EP) . |
| 397786 | | 5/1909 | (FR) . |
| 1181246 | * | 2/1970 | (GB) . |
| 1523413 | * | 8/1978 | (GB) . |
| 2 088 422 | | 6/1982 | (GB) . |
| WO 92/19429 | | 11/1992 | (WO) . |
| WO 94/06638 | | 3/1994 | (WO) . |
| WO 96/38275 | | 12/1996 | (WO) . |

OTHER PUBLICATIONS

Arnold Alscher, Gerd Collin & Günter Streckert, "150 Jahre Holzschutz mit Teeröl," Holz Zentralblatt, Stuttgart, Nr. 132/133, Nov. 4, 1998, pp. 2014–2022.

* cited by examiner

*Primary Examiner*—Erma Cameron
(74) *Attorney, Agent, or Firm*—Evenson, McKeown, Edwards & Lenahan, P.L.L.C.

(57) ABSTRACT

A wood treatment process in which lignocellulosic materials are treated for several hours in a liquid bath of oil with the exclusion of oxygen. The liquid bath at that time has a temperature of 180 to 260° C. By thermal action the wood substance is converted, so that some properties of these materials are altered. Resistance against wood-destroying fungi, for example, is improved.

7 Claims, No Drawings

WOOD TREATMENT PROCESS

BACKGROUND AND SUMMARY OF THE INVENTION

This application claims the priority of German application No. 198 52 827.2, filed Nov. 17, 1998, the disclosure of which is expressly incorporated by reference herein.

This invention relates to a wood treatment process in which the wood is thermally treated. More particularly, this invention relates to a process in which materials containing lignocellulose are immersed in hot oil for a set period of time.

A wood treatment process of this type is the subject of DE 1 000 592. The imbibing process explained in this patent serves to soak wood through with oil or other imbibing agents as quickly as possible in order to modify properties of the wood. By using radio-frequency the imbibing at an oil bath temperature of 200° C. is said to be accomplished in a few minutes. By such a process resistance to wood-destroying fungi can be increased only to the extent that appropriate biocides are added to the oil.

The treatment of wood in hot oil which contains a biocide for protection against decay and blue rot is described for example in DE 30 43 659 A1. Such agents, however, are objectionable for reasons of environmental protection and can endanger health.

It is found in DE 29 16 677 that, for the protection of wood, it is also known to expose the wood in an autoclave under a protective gas to temperatures above 180° C. for 0.5 to 8 hours. By this heat treatment it is said that good resistance to fungi and good dimensional stability of the wood are achieved. Treatment of wood in an autoclave, however, requires relatively expensive equipment and is therefore impractical in small businesses. The thermal conversion of wood has the advantage over other wood protection processes, such as pressure impregnation in vats, has the advantage that the preservative effect is achieved by the heat, so that no environmentally objectionable biocides need to be used, and also material which contains nitrocellulose but is poorly or not at all impregnable can be sanitized through its entire cross section. It is a disadvantage in this kind of heat treatment, however, that in a gaseous atmosphere, at the required high temperatures (160–200° C.), due to the relatively poor transfer of heat by gases and the sensitivity of the entire sanitizing process, an irregular sanitization often results, with some loss of resistance to wood-destroying fungi.

Vat impregnation is in especially widespread use as a wood protection process. The wood products are immersed in a vat under a pressure of 7–14 bar at normal temperatures, in a salt solution which is often a chromate-copper salt-borate mixture or other mixture containing chromate. Pressure impregnation has proven to be a very effective wood protecting process, but for environmental reasons objections are raised increasingly against the use of solutions containing heavy metals, because it is not impossible that these substance may be washed out of the wood in the course of time and thus pass into the soil and the ground water. In the practice of the process danger can be created for the persons performing it and to the environment by its waste water. Wood protection processes of the above kind are recommendable in wood products which are exposed to weather, especially wood framing, fences or outdoor benches.

Some time ago there was a report in the literature on using molten metal as a heat vehicle and immersing the wood into a hot metal bath in order to achieve an improvement of its dimensional stability and resistance to wood-destroying fungi. Such processes, however, have not become widespread because they have not produced satisfactory results.

A wood protection process under the name, "Royal Treatment," or "Royal Verfahren" is known (similar to DE 3043659 A1), in which wood is immersed in an oil bath at a temperature of 130° C. to 140° C. This temperature is chosen in order to permit better penetration of the oil into the wood and permit good surface treatment. The wood protection, however, is achieved by a preliminary treatment with biocides, since at this temperature no thermal conversion of wood takes place to the necessary extent.

The lowering of viscosity by heating oils has been practiced for years also in the impregnation of tar oils (e.g., DE 4112643). Heat treatments are also used for the additional hardening of modified vegetable oils in impregnated wood (e.g., WO 96/38275). These processes, however, can be used only with easily impregnable wood species. Woods not easily impregnated cannot be sanitized.

This invention is addressed to the problem of developing a wood treatment process of the kind stated above, which will result in a very high, uniform protection of the material through its entire cross section, but will not necessitate the use of health-endangering substances or substances that are objectionable for environmental reasons, minimize the loss of the advantageous properties of wood, and can be performed with a very simple apparatus.

Other than in the operating examples, or where otherwise indicated, all numbers expressing temperatures, pressures, quantities of ingredients, or reaction conditions used herein are to be understood as modified in all instances by the term "about".

This problem is solved by the invention in that, for controlled thermal conversion, the oil treatment time amounts to several hours and the temperature of the oil to 180° C. to 260° C.

By the method of the invention exactly the same preservative action is accomplished as in thermal treatment under protective gas, without the need for using wood protection agents that are objectionable for environmental reasons. However, since hot oil is used instead of protective gas, it is possible to perform the process with relatively simple apparatus, so that even smaller businesses can use the method of the invention. In contrast to other wood protection processes, whose protective effect is based on impregnation with various substances, by this process even poorly impregnable materials containing lignocellulose, such as spruce, poplar or bamboo can be uniformly sanitized throughout their cross section by thermal conversion, since no substances have to be put into the material. The protective effect is produced by the thermal conversion of the lignocellulosic substance, and the oil serves as the heat transmitter and protects the material against the action of oxygen. Emitted gases prevent the penetration of the oil during the heat treatment, so that, for example, only a few millimeters of wood are oil impregnated and can be planed off, so that oil-free, sanitized wood products can be produced. If necessary, easily impregnable wood species, such as pine sapwood can be impregnated by cooling the oil after the thermal treatment.

During the treatment of the wood by the hot oil which causes thermal conversion of the lignocellulosic substance, resins and other substances move out of the wood into the oil. This alters the constitution of the oil.

It was found that the oil treatment according to the invention is very uniform and in addition to elevated resistance to wood-destroying fungi, a high dimensional stability results.

On account of the good heat-transfer quality of oils, advantages are achieved in thermal treatments of large amounts of lignocellulose-containing products, in contrast to heat treatments in a gaseous atmosphere, since at the required high temperatures more uniform treatment conditions in the entire reactor chamber are possible. Liquid tree resins and pyrolysis products issuing from the wood are dissolved in the vegetable oils and can be further processed together with the oil. In this process no water or steam are needed, so that water consumption is minimal. Material and apparatus costs incurred in processes using inert gas are also reduced.

The necessary heating of the oil is usually possible without substantial additional costs in woodworking operations, since in such operations waste wood is produced which can be burned to produce the necessary heat. The heated oil can be pumped out at the end of the treatment, so that the thermal energy stored in the oil can be quickly transferred with low energy losses to other reactor tanks. The high oil temperatures of 180–260° C. according to the invention in contact with moist lignocellulosic products do not produce any cracking. For example, freshly sawn spruce blocks of large dimensions measuring 100×100×1350 $mm^3$ were sanitized thermally in hot rape oil without any cracking throughout their entire cross section.

The process of the invention has been practically tested thus far with poplar and spruce wood, and in laboratory tests an improvement in dimensional stability and resistance to wood-destroying fungi was found. As for length of treatment, a few hours is usually sufficient, but the length depends on the moisture content of the material and the dimensions, and if the levels are high it can amount to several days. A treatment time of 4.5 hours was found sufficient for specimens measuring 50×25×15 $mm^3$ and an initial moisture content of 6%.

DETAILED DESCRIPTION OF PREFERRED EMBODIMENT

Example

Fresh, untreated pine wood (*Pinus sylvestris* L.) and spruce (*Picea abies* L. karst) was cut to the dimensions given in Table 1. For the hot oil treatment the specimens with a moisture content of 6% were treated at three temperatures (180° C., 200° C. and 220° C.), without pressure, in an oil bath of pressed, refined linseed oil with the exclusion of oxygen. After the desired temperature was reached the wood specimens were immersed for 4.5 hours in the hot oil. The samples cooled in the oil bath for 15 minutes. Comparative samples were treated in the drying oven at the same temperatures in an air atmosphere, also for 4.5 hours.

TABLE 1

| Dimensions of the specimens | | | | |
|---|---|---|---|---|
| Kind of test | cracking/ surface/ masses | Dimensional change/ASE | E-modulus/ Fracture impact effort | Flexural Resistance to *C. puteana* |
| Type of wood [$mm^3$] | Pine billet 40 × 70 × 100 | Pine billet 20 × 20 × 10 | Pine billet 10 × 10 × 150 | Spruce billet 15 × 25 × 50 |

Results:

Mass Change:

The mass increase WPG (weight-percent gain) of the hot-oil treated specimens was 50–70% (Table 2). The specimens heat-treated in air showed mass losses of up to 10%, depending on the treatment temperature. Since the oil content produced an increase in mass, any possible loss of wood substance as a consequence of the hot oil treatment cannot be precisely determined.

TABLE 2

| Mass change caused by the treatment [%] | | | | | | |
|---|---|---|---|---|---|---|
| | 180° C. oil | 180° C. air | 200° C. oil | 200° C. air | 220° C. oil | 220° C. air |
| Pine | 51.28 | −1.94 | 40.87 | −2.93 | 42.14 | −8.46 |
| Spruce | 18.00 | −1.99 | 12.42 | −2.86 | 9.97 | −8.24 |

Cracking, Surface Quality:

None of the wood specimens heat treated in oil showed cracking. The surfaces were uniformly brown, in contrast to the surfaces of air-dried specimens which had spotty discoloration from oozing resin.

Dimensional Changes:

The specimen dimensions are decreased both by the hot-oil treatment and by the heat treatment in an air atmosphere according to the treatment temperature, dimensions in the tangential direction decreasing more greatly than in the radial direction (Table 3). At 200° C. the dimensional changes due to the hot-oil treatment were slightly greater in the tangential direction than in the case of heat treatment in an atmosphere of air.

TABLE 3

| Dimensional changes due to the treatment [%] | | | | | | |
|---|---|---|---|---|---|---|
| | 180° C. oil | 180° C. air | 200° C. oil | 200° C. air | 220° C. oil | 220° C. air |
| radial | 0.04 | −0.07 | −0.43 | −0.62 | −1.14 | −1.89 |
| tangential | −0.20 | −0.29 | −0.86 | −0.74 | −1.63 | −2.76 |

Reduction of Swelling and Shrinkage (ASE):

The ASE improvement of specimens which were treated at 220° C. was around 40% for both kinds of treatment of similar orders of magnitude (Table 4). The degree of improvement depended upon the relative atmospheric humidity. With increasing atmospheric humidity the ASE decreased, specimens treated at higher temperatures showing fewer differences than those treated at lower temperatures.

TABLE 4

| ASE [%] | | | | | | |
|---|---|---|---|---|---|---|
| | 180° C. oil | 180° C. air | 200° C. oil | 200° C. air | 220° C. oil | 220° C. air |
| ASE 20/35 | 29 | 41 | 43 | 37 | 44 | 46 |
| ASE 20/65 | 21 | 27 | 35 | 28 | 40 | 41 |
| ASE 20/85 | 19 | 22 | 31 | 27 | 38 | 40 |

Flexural Elasticity Modulus/Fracture Impact Effort:

The highest flexural elasticity moduli in hot-oil treated specimens were reached at 200° C. with 11000 $N/mm^2$ (Table 5). The flexural elasticity modulus figures known from the literature for the flexural elasticity modulus were not lower by either treatment process. On the other hand the impact toughness decreased with increasing treatment temperature, but less in the case of hot-oil treatment than treatment in an air atmosphere (Table 6).

TABLE 5

| Flexural elasticity modulus N [/mm$^2$] | | | | | | |
|---|---|---|---|---|---|---|
| 180° C. oil | 180° C. air | 200° C. oil | 200° C. air | 220° C. oil | 220° C. air | Controls |
| 10259 | 10029 | 11002 | 9801 | 10162 | 9445 | 9986 |

TABLE 6

| Impact strength effort [%] | | | | | | |
|---|---|---|---|---|---|---|
| 180° C. oil | 180° C. air | 200° C. oil | 200° C. air | 220° C. oil | 220° C. air | Controls |
| 85.45 | 62.89 | 59.8 | 50.84 | 50.84 | 37.02 | 100.00 |

Resistance to *Coniophora puteana:*

The resistance of spruce and pine to the brown mold fungus *Coniophora puteana* was increased at temperatures above 200° C. In the case of hot-oil treated specimens a definitely lower loss of mass was found than in hot-air treated specimens. For pine billets, when a hot-oil treatment was applied at 200° C., a mass loss of less than 2% was found; in the case of spruce, however, only at 220° C. was a decided increase of resistance achieved (Table 7). Untreated spruce controls, however, show a loss of mass of 48%, pine controls a loss of 40%.

TABLE 7

Losses of mass after 19 weeks of exposure of heat-treated specimen according to DIN EN 113 (Fungus: *Coniphora puteana*)

| | Hot-oil treatment | | | | Hot-air treatment | | | |
|---|---|---|---|---|---|---|---|---|
| | Pine billets | | Spruce | | Pine billets | | Spruce | |
| Treatment | [g] | [%] | [g] | [%] | [g] | [%] | [g] | [%] |
| 180° C. | 1.1 | 13.0 | 1.2 | 15.0 | 2.3 | 25.0 | 2.5 | 31.2 |
| 200° C. | 0.1 | 1.9 | 1.1 | 13.1 | 1.0 | 15.8 | 2.2 | 26.7 |
| 220° C. | 0.1 | 2.0 | 0.0 | 0.0 | 0.9 | 11.0 | 0.4 | 5.5 |

Since the lignocellulosic material treated by the process of the invention has an improved dimensional stability, finishes on the wood surface adhere better than on untreated material. Due to the oil content, the lignocellulosic material treated by the process of the invention, compared with material treated by the known process, has the advantage among others that it is easier to machine and nails can be driven into it more easily. Also, due to the oil, the generation of unhealthy fine dust is prevented or at least greatly reduced. In the process of the invention, the oil content can easily be adapted to a particular application and, for example, be made greater in wood products to be used in contact with the soil than in those which are only exposed to weather but not contact with the soil.

An additional advantage of the process of the invention lies in the fact that the oil is very rapidly absorbed after the treatment, so that even a few minutes after treatment the surface of the wood is dry. The resin spots often occurring on the surface in hot treatment in a gaseous atmosphere are prevented in the oil-bath treatment according to the invention, because the escaping resin is uniformly distributed in the oil. Undesired embrittlement of the lignocellulosic material can be reduced if the heat treatment is performed in an oil bath with the exclusion of oxygen.

Linseed oil and rape oil were practically tested, and protective effects of comparable quality were achieved. In addition to serving as a heat transfer medium, the oil can also serve as a surface coating means if the liquid bath is cooled down together with the material in it after the heat treatment and the material is then air-conditioned at room climate, and then heated to 60 to 180° C. With this cooling and subsequent heating a continuous, fully hardened oil film forms on the surfaces of the wood. This will also bring it about that the brown coloring of the surface created by the oil will be more lasting, while otherwise oiled wood surfaces in nature quickly bleach out.

It is advantageous if the oil has an initial temperature of at least 180° C. Thus a fast, energy-saving treatment is possible without the surface cracking of lignocellulosic materials, even those with moisture contents above fiber saturation and relatively large dimensions.

What is claimed is:

1. A process for treating wood comprising immersing wood in an oil bath at 180° C. to 260° C. for for at least a few hours to achieve thermal conversion of lignocellulosic materials.

2. A process for treating wood according to claim 1, further comprising impregnating the lignocellulosic materials after being thermally converted with an oil which is altered during the thermal conversion of the lignocellulosic materials due to resins and pyrolysis products that seep out of the wood into the oil thereby altering the constitution of the oil.

3. A process according to claim 1, wherein said oil is a vegetable oil.

4. A process according to claim 1, further comprising treating said wood in said oil bath with the exclusion of oxygen.

5. A process according to claim 1, further comprising treating said wood in said oil bath at a pressure of 2 bar to 14 bar.

6. A process according to claim 5, further comprising treating said wood in said oil bath with the exclusion of oxygen.

7. A process according to claim 1, further comprising cooling the oil bath after the end of the thermal conversion, removing the wood from the bath, exposing the wood to air at room climate and then heating the wood in an air atmosphere at 60 to 280° C. to form a hardened oil film on the surface of the wood.

* * * * *